United States Patent [19]

Bosse-Platiere

[11] 4,191,265

[45] Mar. 4, 1980

[54] WELL BORE PERFORATING APPARATUS

[75] Inventor: Michel J. Bosse-Platiere, Houston, Tex.

[73] Assignee: Schlumberger Technology Corporation, New York, N.Y.

[21] Appl. No.: 915,498

[22] Filed: Jun. 14, 1978

[51] Int. Cl.[2] ..... E21B 43/117

[52] U.S. Cl. ..... 175/4.56; 102/24 HC; 175/4.6

[58] Field of Search ..... 175/4.6, 4.56; 102/24 HC

[56] References Cited

U.S. PATENT DOCUMENTS

| | | | |
|---|---|---|---|
| 2,843,041 | 7/1958 | Stewart | 102/24 HC |
| 3,016,014 | 1/1967 | Ledourg | 102/24 HC |
| 3,053,182 | 9/1962 | Christopher | 102/24 HC |
| 3,241,488 | 3/1966 | Glass | 102/24 HC |
| 3,276,369 | 10/1966 | Bell | 102/24 HC |
| 3,717,207 | 2/1973 | Shore | 175/4.6 |

FOREIGN PATENT DOCUMENTS

| | | | |
|---|---|---|---|
| 1242848 | 11/1958 | France | 175/4.6 |

*Primary Examiner*—William F. Pate, III

[57] ABSTRACT

In the representative embodiment of the present invention disclosed herein, a plurality of generally-cylindrical modular bodies are tandemly assembled within a typical end-loaded perforating carrier. A generally-longitudinal passage containing a detonating explosive is arranged in each of the modular bodies so that, when the bodies are tandemly assembled in a carrier, these passages will collectively define a continuous passage through which detonation-inducing forces can be transmitted. Shaped charges are mounted in at least some of the modular bodies and positioned to be fired upon detonation of the explosive in the continuous passage.

27 Claims, 4 Drawing Figures

FIG. 1
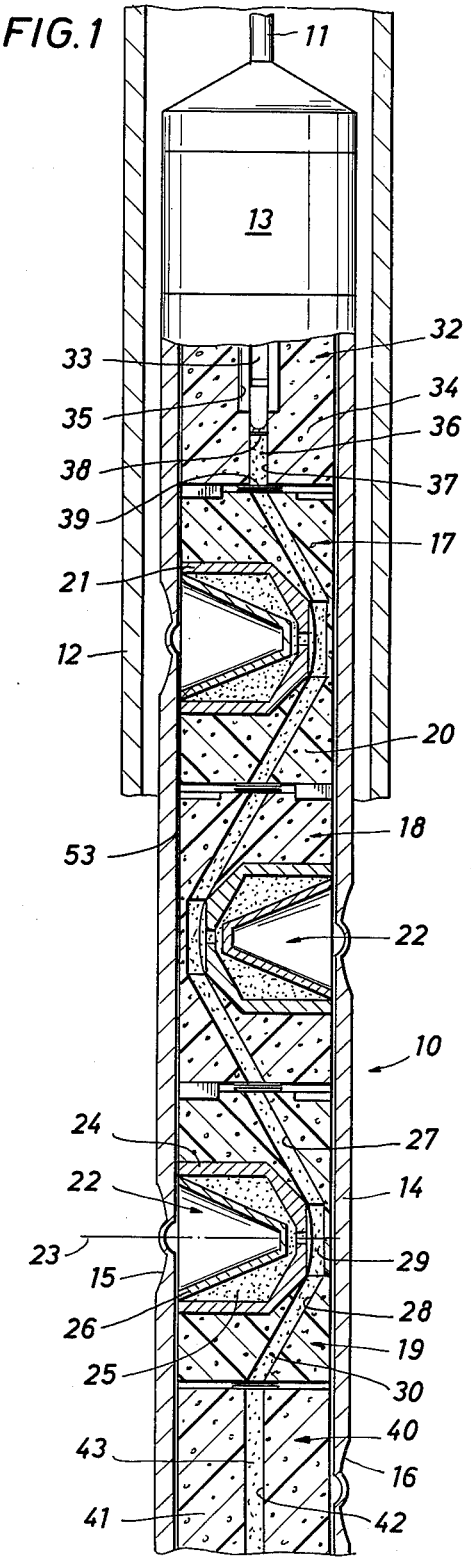
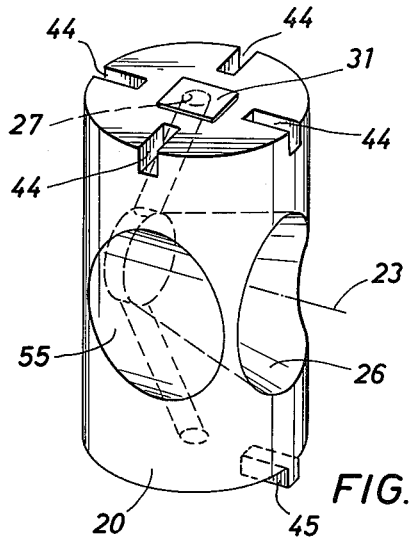
FIG. 2
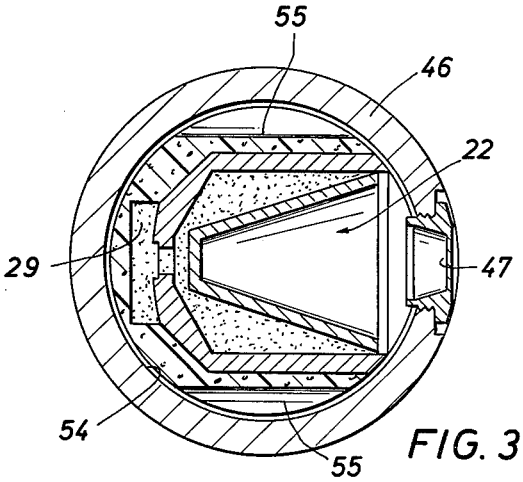
FIG. 3
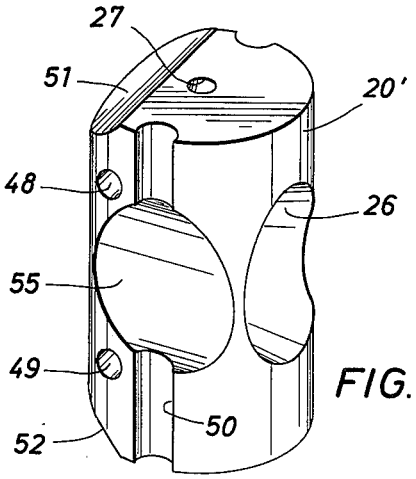
FIG. 4

WELL BORE PERFORATING APPARATUS

Many of the oil-field perforating guns used today employ two or more laterally-directed shaped-explosive charges that are mounted at longitudinally-spaced intervals within an enclosed tubular body. When these charges are to be fired simultaneously, an extended length of a flexible, so-called "detonating cord" is secured to the base of each charge and an electrically-responsive detonator is crimped to one end of the cord. When the gun is readied for operation, the leads of the detonator are electrically connected to conductors in the cable supporting the perforator. With one type of these perforating guns, the gun body is designed to withstand the repeated detonations of many different sets of explosive charges that are successively loaded into the perforator. To facilitate reuse of these thick-walled carriers, the shaped charges are respectively arranged so that each will fire through spaced side ports in the carrier wall which are closed by expendable port-closure plugs. Although the charges can be made small enough to pass through large-diameter side ports, to achieve maximum performance for a given size of carrier it is ordinarily preferred to use the largest-possible shaped charges and instead install these charges through the open ends of the carrier.

In what is probably the most-widely used technique for loading such "end-loaded" carriers, a length of detonating cord is extended along the interior bore of the carrier. A speciallydesigned charge-holding tool is then used to successively insert the shaped charges into the gun one at a time and then hold each charge adjacent to its assigned port while an expendable plug is installed to secure the charge in place against the detonating cord. Once the wiring for the detonator is completed, the ends of the carrier are closed and the gun is then in readiness for operation.

Another and more-effective loading arrangement is illustrated in U.S. Pat. No. 3,773,119. As described in that patent, all of the charges for a given end-loaded carrier are mounted in holes spaced along the sides of an elongated cardboard or plastic tube and a length of detonating cord is then spiraled around this so-called "charge-loading tube" so as to be operatively positioned against the base of each shaped charge. The detonator wiring is completed and the entire assembly is then inserted into the carrier and positioned as necessary to face each shaped charge toward its assigned port so that threaded port plugs can then be installed in the carrier to secure the charges in position. In a somewhat similar fashion, a third type of end-loaded perforator is arranged so that its shaped charges are instead secured within complementary openings formed at spaced intervals along an elongated metal strip.

In addition to these aforementioned commercially-used perforating guns, various proposals have also been advanced heretofore for different arrangements of enclosed-carrier guns that might also be considered as being end-loaded guns. As one example of such alternative arrangements, instead of sealingly enclosing the entire carrier to isolate the explosives from the well bore fluids, the perforator disclosed in U.S. Pat. No. 2,742,857 has its shaped charges individually enclosed within separate fluid-tight containers that are tandemly stacked within the unsealed carrier. A fluidly-isolated detonating cord is extended along the interior of the carrier and cooperatively positioned outside each of the fluid-tight containers as required for detonating the several charges. Those skilled in the art will appreciate, however, that in addition to being somewhat complicated to load, that proposed arrangement needlessly limits the size of charges that can be used in a given size of the carrier.

A large number of perforators which are also widely used today employ so-called "expendable" or "through-tubing" enclosed carriers such as those fully described in U.S. Pat. Nos. 3,048,102 and 3,429,384. With expendable perforators such as these, the shaped charges are mounted along an elongated metal strip arranged like those commonly used in the above-described third type of end-loaded carriers. Similarly, once the charges are mounted on the charge-supporting strip, a length of detonating cord is secured to the carrier strip and positioned so as to be in detonating proximity of each shaped charge.

Various perforating guns have also been proposed heretofore in which modular support members respectively carrying shaped charges are stacked in thin-walled expendable carriers. By way of example, U.S. Pat. Nos. 2,968,243 and 2,980,017 show guns of this type in which a stack of annular mounting bodies each carrying shaped charges is wrapped with a length of detonating cord before the stacked modules are inserted into a thin-walled carrier. Hereagain, it is obviously a time-consuming task to assembled the modules into a stack, spiral the cord around the stack, and install the assembly in the carrier.

Those skilled in the art recognize that, for the large part, none of these above-described loading arrangements are entirely satisfactory. For one thing, all of these loading techniques require a considerable amount of time. Each shaped charge must be individually handled. Once the charges are installed, a length of detonating cord must be prepared, and either wrapped around or laid along the charge-supporting member to position it in an operative relationship with each of the charges. The wiring for the detonator must then be prepared and fastened at spaced intervals along the support. Once this is finished, the completed assembly is then inserted into the carrier and secured in position. With so much handling, it is not at all uncommon to unwittingly damage either the detonating cord or the electrical wires running to the detonator which may thereby subsequently cause the perforating apparatus to inadvertently misfire.

These various problems are, of course, significantly compounded even further whenever last-minute changes must be made in the particular loading arrangement of a given end-loaded perforating gun. For instance, with guns such as these, it is customary to utilize either two or four shaped charges for each foot of carrier length. Thus, in the absence of advance knowledge as to how a particular perforating job will actually be carried out, the usual practice is to initially load each perforating carrier with four charges per foot and then subsequently remove every other charge should it later become necessary to reduce the number of charges. Regardless of the type of gun, such last-minute changes are time consuming; and, all too often, these changes must be made at the wellsite and under the worst-possible working conditions. It will be recognized that human errors and mistakes are made much more frequently where such changes are hurried and must be made under unfavorable working conditions. Thus, in addition to creating a potential safety risk when a malfunctioning perforator is subsequently unloaded, the resulting time loss obviously represents a needless expense.

Accordingly, it is an object of the present invention to provide new and improved perforating apparatus which is cooperatively arranged so that a plurality of shaped explosive charges can be quickly and reliably installed in any one of several selected loading arrangements in typical reusable and expendable end-loaded carriers.

This and other objects of the present invention are attained by respectively mounting each of a group of shaped explosive charges within a modular body that is cooperatively arranged for providing one or more voids or gas-expansion spaces within a carrier as well as for defining an enclosed, explosive-containing passage that extends the full length of the modular body and is in detonating proximity with the base of its associated shaped charge. In the practice of the invention, two or more of these pre-assembled modules are successively inserted into and tandemly disposed within a tubular perforating carrier so as to position the explosive-filled passage in each module within effective detonating proximity of the explosive-filled passages in the immediately-adjacent charge-supporting modules as well as correctly orient the several charges along designated perforating axes.

The novel features of the present invention are set forth with particularity in the appended claims. The invention, together with further objects and advantages thereof, may be best understood by way of the following description of exemplary apparatus employing the principles of the invention as illustrated in the accompanying drawings, in which:

FIG. 1 shows an expendable perforating gun arragned in accordance with the principles of the present invention;

FIG. 2 is an isometric view of a preferred embodiment of a charge-supporting module which is suitable for use with both expendable and non-expendable perforating guns;

FIG. 3 is a cross-sectional view of a typical thick-walled perforating carrier in which one of the new and improved charge modules of the present invention has been installed; and FIG. 4 depicts an alternative embodiment of a charge-supporting module which is also arranged in keeping with the objects of the present invention.

Turning now to FIG. 1, one embodiment of new and improved perforating apparatus 10 incorporating the principles of the present invention is depicted as it will appear while suspended from a typical armored cable 11 in a typical well bore such as may be defined by a string of small-diameter production tubing 12 disposed within a large-diameter casing. To show one typical utilization of the present invention, the perforator 10 is shown as it is being lowered out of the string of small-diameter tubing 12 and moved to a selected depth location where the gun is to be subsequently operated.

To provide one or more depth-correlation signals, the perforating apparatus 10 further includes means such as a typical collar locator or a gamma-ray detector cooperatively arranged in an enclosed body 13 and adapted for transmitting electrical output signals to the surface from which the depth location of the perforating apparatus can be readily and accurately determined.

As illustrated, the through-tubing perforating apparatus 10 also includes a thin-walled tubular carrier 14 which is dependently supported below the body 13. Although other types of expendable carriers can be used, the depicted carrier 14 is preferably arranged in keeping with the teachings of U.S. Pat. No. 3,429,384; and, as shown at 15 and 16, the carrier is provided with a plurality of longitudinally-spaced recesses containing smaller outwardly-projecting dimples that are uniformly arranged along one or two sides of its exterior wall.

In keeping with the objects of the present invention, the new and improved perforating apparatus 10 further includes perforating means including a plurality of uniquely-arranged pre-assembled, charge-supporting modules 17–19 which previously have been successively inserted through an end opening of the carrier 14 in a predetermined order so as to dispose the tandemly-stacked modules in a selected arrangement for a given perforating operation. As illustrated, each of the several charge-supporting modules 17–19 includes a generally-cylindrical rigid body 20 that is sized to be loosely fitted within the interior bore of carrier 14. An outwardly-facing, generally-frustoconical cavity 21 is formed on one side of each module body 20 and sized for carrying a typical shaped-explosive charge 22 arranged for producing a perforating jet along a selected lateral axis 23. In the preferred embodiment of the new and improved perforating apparatus 10 illustrated in FIGS. 1 and 2, these module bodies, as at 20, have an overall length of three inches and are each arranged with its charge-receiving cavity 21 substantially centered so as to facilitate loading of the carrier 14 with four of these pre-assembled charge-supporting modules per foot of carrier length. As depicted in FIG. 1, each of the shaped charges 22 preferably includes an outer case 24 of steel which contains a compacted explosive pellet 25 having a frustoconical metal liner 26 mounted in a complementally-shaped hollow or cavity in the forward end of the pellet.

To provide for effective or so-called "high order" detonation of its associated shaped charge 22, each module body, as at 20, is provided with a generally-longitudinal, elongated explosive passage which, in the depicted preferred embodiment of the present invention, is divided into upper and lower short passages 27 and 28 respectively having their inner ends terminating at a centrally-located cavity 29 intersected by the lateral perforating axis 23. To better accommodate the largest-possible shaped charge 22, the central cavity 29 is preferably located immediately to the rear of the charge-receiving cavity 21 and, in many instances, this smaller cavity may well be nothing more than a recess or counterbore in the base of the larger cavity. Although the steel cases 24 are shown with a perforated rear wall, those skilled in the art will recognize, of course, that the sensitivity of the shaped charges 22 would be reduced only slightly by providing a thin rear wall of selected minor thickness that will not unduly impair high-order detonation of the charge upon application of a detonating force on the detonation-initiating base portions of the charges.

The outer of terminal ends of the upper and lower passages 27 and 28 are respectively terminated in predetermined corresponding locations in the upper and lower ends or faces of each module body 20, with these locations preferably being the geometrical centers of the upper and lower transversely-oriented end faces of the body so as to assure matching alignment of the passages in each of the charge-supporting modules 17–19 with the passages in the adjacent modules regardless of how the tandemly-assembled modules may be angularly oriented. The interconnected passages 27 and 28 and the central cavity 29 are respectively filled with a quantity of loosely-compacted RDX or some other typical detonating explosive as at 30.

To prevent loss of the detonating explosive 30 as well as to avoid the unwanted entry of moisture, the exposed ends of the upper and lower passages 27 and 28 are respectively covered by membrane-like metal or plastic closures 31 of insufficient thickness to significantly impair or prevent the transmission of effective detonating forces to the explosive 30 and, from there, to the explosive pellet 25 so as to assure high-order detonation of the pellet. As a matter of preferred practice, a strip of a typical pressure-sensitive tape of a water-impervious plastic material is well suited to provide these protective covers as at 31.

In addition to the several charge-supporting modules 17–19 , the scope of the present invention also encompasses a self-contained, preassembled module 32 which is specially arranged for cooperatively transferring effective detonating forces from a typical electrically-responsive detonator, as at 33, to the immediately-adjacent charge-supporting module in the tandemly-assembled stack of modules. In its preferred embodiment illustrated in FIG. 1, this detonation-transferring module 32 has a cylindrical body 34 of similar or identical size as those of the charge-supporting modules 17–19 and includes an enlarged axial bore 35 in the upper portion of the body that is cooperatively sized for snugly receiving the detonator 33 and maintaining it within effective detonating proximity of a loosely-compacted volume of RDX or some other suitable detonating explosive 36 which fills an adjacent communicating passage 37 in the lower portion of the body. This detonation-transferring explosive 36 is also preferably retained within the passage 37 by strips 38 and 39 of a fluid-impervious metal foil or pressure-sensitive plastic tape. Those skilled in the art will appreciate, of course, that since the successful detonation of adjacent or contiguous explosives, as at 30, 33 and 36, depends upon the transmittal of a detonation front from one exposive to another, these tape strips 38 and 39 must also be quite thin.

To achieve maximum flexibility in the practice of the present invention, a third type of a self-contained module, as at 40, is also provided, with this preassembled module being cooperatively arranged for transmitting effective detonation forces from one charge-supporting module, such as at 19, to another charge-supporting module (not seen in FIG. 1) which is spatially separated therefrom by several inches. As illustrated in FIG. 1, in one of its preferred embodiments, this third module 40 may be arranged in the form of an elongated cylindrical body 41 having the same or similar cross-sectional configuration as the bodies 20 and 34. The body 41, however, has only a single axial passage 42 that is completely filled with loosely-compacted RDX or some other suitable detonating explosive 43. It will be appreciated, therefore, that these detonation-transmitting modules, as at 40, will act as spacers within a given carrier, as at 14, whenever a shaped charge, as at 22, is not to be positioned adjacent to a given recess as at 16. It will also be recognized that one of the detonation-transmitting modules 40 could also be interposed between the modules 17 and 32 should that arrangement offer any particular advantage. Although the overall length or vertical height of the module body 41 is preferably made equal to the vertical height of the module body 20, the body of this third type of module 40 could alternatively have an overall length corresponding to the combined vertical heights of two or more of the bodies of the charge-supporting modules 17–19. The particular choice of length is, of course, of minor consequence so long as those charge-supporting modules, such as at 19, above and below this third type of module 40 remain at the correct longitudinal position in the carrier 14.

It will be further appreciated that in addition to making certain that the several shaped charges will be spaced at the correct longitudinally-spaced intervals within the carrier 14, it is also essential that each shaped charge, as at 22, be angularly oriented with relation to a selected perforating axis, as at 23, and properly faced to be certain of firing through the center of a selected wall portion in the carrier such as an assigned recess as at 15. Accordingly, to be certain that each of the several modules 17–19 in a given stack of tandemly-assembled modules are retained in a correct angular orientation within the carrier 14, each of these charge-supporting modules as well as the spacer modules 40 further includes interfitting body-orienting means such as may be conveniently provided by one or more holes or radially-extended grooves, as at 44, arranged or formed at predetermined locations in one transverse end surface of each module and a complementally-shaped orienting member such as a mating pin or radially-disposed key 45 arranged or formed at a predetermined location in the other transverse face of that module. It will be appreciated that since the detonation-transferring module does not have to be oriented in any particular direction, that module has no need for such orienting keys or grooves so long as the module 32 is operatively positioned with respect to the next-adjacent module as at 17. Thus, as the several modules 17–19 and 40 are successively inserted into the perforating carrier 14, each of the modules will be correctly oriented in relation to the immediately-adjacent module which has just been loaded into the carrier so that it will be known that the stacked modules will have each shaped charge, as at 22, in facing alignment with its particularly-assigned recess as at 15. It should be noted as well that when extremely-long carriers 14 are being loaded, the charge-supporting modules 17–19 and, if they are used, the spacer modules 40 can also be divided into two sets and inserted from each end of the carrier should it be deemed advisable to at least minimize the possibly-adverse effects of accumulated minor angular misalignments that could well occur with a stack of a large number of these preassembled modules.

Accordingly, it will be appreciated that with the several preassembled modules 17–19, 32 and 40 arranged in accordance with the principles of the present invention, the carrier 14 can be efficiently and rapidly loaded with a selected number of shaped charges as at 22. As the several charge-supporting modules 17–19 are respectively inserted into the carrier 14, the modules are successively positioned and angularly oriented as described above to respectively align each of the shaped charges 22 in a facing relationship with its assigned recess as at 15. Once the uppermost charge-supporting module 17 is installed, the detonator-supporting module 32 is inserted into the carrier 14 and the detonator 33 is electrically connected to the electrical cable 11 supporting the carrier. The perforator 33 will then be in readiness to be lowered into the production string 12 and operated once it has reached the proper depth location in the well bore.

It will, of course, be appreciated that although the preceding description has been directed to the utilization of the several modules 17–19, 32 and 40 in expendable carriers as at 14, the objects of the present invention can also be carried out with typical thick-walled reusable end-loaded carriers such as shown generally at 46 in FIG. 3. For instance, once the carrier 46 is loaded with a selected number of the preassembled modules such as those previously described with respect to FIG. 1, each of the tandemly-assembled charge-supporting modules, as at 17, will similarly be longitudinally positioned and angularly oriented so that the shaped charge 22 will fire through the center of an expendable port plug, as at 47, threaded into a port in a selected wall portion of the carrier. Those skilled in the art will recognize, of course, that aside from the installation of the threaded port plugs, as at 47, into the carrier 46, the assembly of the associated perforating apparatus of the present invention will otherwise be carried out in the same way as for the expendable perforator 10.

As previously discussed, it is often necessary to make last-minute changes in the number of shaped charges which will ultimately be utilized in a given perforating operation. It will be recognized, however, that by means of the present invention it is quite simple to quickly modify the charge arrangement in a given perforator as at 10. For instance, assume that the carrier 14 had initially been loaded with shaped charges, as at 22, respectively facing each of the several external recesses, as at 16, and a decision is later made to reduce the number of charges by one half before the gun 10 is finally operated. To carry this out, the several modules 17–19 and 32 are easily removed and the carrier 14 is quickly reloaded but now with the remaining ones of those charge-supporting modules which are to be used instead being alternately disposed between a corresponding number of detonation-transmitting modules, as at 40. To prepare the gun 10 for service, the detonator-supporting module 32 is reinstalled into the upper end of the carrier 14 and the electrical leads of the detonator 33 are connected to the supporting cable 11.

It will be appreciated by those skilled in the art that to avoid localized damage or rupture of the carrier, as at 14 or 46, at least a major number of the several modules 17–19, 32 and 34 must be arranged to accommodate the explosive gasses generated upon detonation of the several shaped charges as at 22. Failure to provide an adequate gas-expansion volume within the carrier, as at 14, can easily result in the thin walls of the carrier either bursting or being excessively swollen when the charges, as at 22, are detonated. In either case, retrieval of the perforator 10 can well be needlessly impaired or even prevented such as where the carrier 14 must re-enter a tightly-fitting string of piping as at 12.

It has been considered, therefore, that adequate gas-expansion space can be provided in the carriers, as at 14 or 46, in any one of several ways. One arrangement would be to form the several modules 17–19, 32 and 40 from a foamed material of sufficient porosity that these voids cumulatively provide the requisite expansion space. One way of providing this available gas-expansion volume would be to form at least the modules 17–19 (and possibly the modules 32 and 40 as well) from either a silicone sponge rubber or a cellular glass material such as Foamglas® which is an insulating product presently manufactured by Pittsburgh Corning Corporation. A material such as the last-mentioned foamed glass would, of course, easily withstand the high temperatures often encountered in typical well bores. It will be recognized that most, if not all, of the typical foamed plastics commonly used in less-demanding situations would ordinarily be unsuited for service at the temperatures normally encountered in perforating operations.

Another arrangement would be to cast the module bodies 20, 34 and 41 from easily-moldable plastics such as high-temperature polyurethanes or polyphenol sulfides in which tiny hollow beads or bubble-like spheres have been uniformly intermixed to define a sufficient number of voids to cumulatively provide sufficient gas-expansion spaces within the carriers 14 or 46. These plastics can, of course, be formed by typical injection molding techniques that employ suitably-shaped molds having retractable pins which serve as preshaped cores for forming such internal openings as the passages 27 and 28 and the cavities 21 and 29. In a similar fashion, typical bakelites intermixed with hollow spheres can be cast into a desired shape by way of conventional compression-molding techniques.

Another arrangement which may also be employed in the practice of the present invention for providing sufficient gas-expansion space in a carrier, as at 14 or 46, would include the formation of the several module bodies 20, 34 and 41 from castable metals or homogenous plastic materials and either cutting out or casting one or more expansion spaces in each body. Hereagain, in choosing the plastic materials, particular attention must be given to the effects of well bore gasses and high temperatures that may be encountered. Nevertheless, those skilled in the art will recognize that there are many commercially-available metals or homogenous plastics which can be effectively used to cast the module bodies, as at 20, 34 and 41; and that one or more holes, voids, and cut-away portions can be readily arranged in each of these bodies as may be found necessary to cumulatively provide adequate expansion space in a given perforator as at 10. For instance, instead of forming the several module bodies 20, 34 and 41 as geometrically-perfect cylinders, as representatively illustrated in FIG. 4 a module body, as at 20', could alternatively be provided with one or more transverse passages 48 and 49, longitudinal passages or side-wall grooves 50, or any one of several cut-away portions as at 51 or 52. It should be noted that a major portion of the overall expansion space in a given carrier 10 or 46 could also be provided by forming the module bodies, as at 41, with a reduced-diameter central portion and enlarged-diameter upper and lower end portions so as to keep the bodies centered in the carrier. Those skilled in the art will understand that the exact dimensions of these expansion spaces as at 48–52 will depend upon the particular sizes of the shaped charges, as at 22, and the carrier 14 or 46; and that these dimensions may be readily determined by way of routine tests for a given set of modules, as at 17–19, 32 and 40, and a given carrier.

In practicing the present invention, particular attention must also be given to minimizing the laterally-directed shock waves that would otherwise be imposed against the walls of the carriers 14 or 46 whenever a charge, as at 22, is detonated. Thus, regardless of which of these particular arrangements are adopted for providing sufficient space for accommodation of explosive gasses, it is of the utmost importance that a small clearance space be left between the interior wall of the carriers 14 or 46 and at least those side or lateral portions of the bodies 20 most nearly adjacent to the shaped charge, as at 22, in a given module body. In addition to sizing the bodies to leave a minor annular or circumferential clearance space, as at 53 or 54, the bodies 20 of the charge-supporting modules, as at 17, are also formed or shaped to define additional detonation-attentuating clearance spaces, as at 55, in the sides of the mid-portion of each body as illustrated in FIGS. 2 and 4. Hereagain, those skilled in the art will recognize that although the particular dimensions of such lateral clearances, as at 55, will be wholly dependent upon the particular charge, as at 22, and the design parameters of the carrier, as at 14 or 46, these specific dimensions can be readily and expeditiously determined by one or more routine tests.

Accordingly, it will be appreciated that the present invention has provided new and improved perforating apparatus which is particularly adapted for rapid and still reliable loading and unloading of both common types of enclosed perforating carriers. By utilizing the expendable modules provided by the present invention, the heretofore-tedious task of threading detonating cord through a carrier has been eliminated and reloading of carriers at the wellsite is considerably facilitated.

While only particular embodiments of the present invention have been shown and described, it is apparent that changes and modifications may be made without departing from this invention in its broader aspects; and, therefore, the aim in the appended claims is to cover all such changes and modifications as fall with the true spirit and scope of this invention.

What is claimed is:

1. Perforating apparatus adapted for operation in a well bore and comprising:

a tubular carrier having an end opening providing access to the interior bore of said carrier;

a plurality of bodies adapted to be successively introduced through said end opening and tandemly assembled within said interior bore with their opposite ends respectively abutting one another;

charge-detonating means including an elongated passage entirely through each body, each passage of one body communicating with the passage of the abutting body for collectively defining a generally-longitudinal intercommunicating passage through said tandemly assembled bodies, and a detonating explosive cooperatively arranged within each of said body passages and closed entirely in each body by closure means on each end of the body, said detonation-inducing forces being communicated solely via said collectively defined intercommunicating passage for producing detonation-inducing forces therein at predetermined locations within selected ones of said tandemly-assembled bodies;

means defining a laterally-directed charge-receiving opening on each of said selected bodies; and perforating means within each of said charge-receiving openings including a shaped explosive charge including a detonation-initiating base portion cooperatively arranged within detonating proximity of said predetermined locations in said body passages.

2. The perforating apparatus of claim 1 wherein said carrier has longitudinally-spaced wall portions specially adapted to be perforated upon detonation of said shaped charges and further including:

means including body-orienting means cooperatively arranged on each of said bodies for orienting each of said selected bodies within said carrier so as to respectively align the firing axis of each of said shaped charges with said specially-adapted wall portions on said carrier.

3. The perforating apparatus according to claims 1 or 2 wherein said charge-detonating means further include:

an electrically-responsive detonator cooperatively arranged in said carrier within detonating proximity of said detonating explosive in one of said body passages.

4. The perforating apparatus according to claims 1 or 2 wherein said bodies also include at least one body other than said selected bodies and having no shaped charge mounted thereon, with said other body being interposed between at least two of said selected bodies for separating said two selected bodies when said bodies are tandemly assembled within said carrier.

5. The perforating apparatus of claim 4 wherein said charge-detonating means further include:

an electrically-responsive detonator cooperatively arranged in said carrier within detonating proximity of said detonating explosive in one of said body passages.

6. The perforating apparatus according to claims 1 or 2 further including:

means operatively associated with at least some of said selected bodies and adapted for defining a plurality of gas-expansion spaces within said carrier.

7. The perforating apparatus according to claims 1 or 2 wherein at least some of said selected bodies are formed of a porous material for defining multiple gas-expansion spaces within said carrier.

8. The perforating apparatus according to claims 1 or 2 wherein at least some of said selected bodies are cooperatively arranged and shaped for defining multiple gas-expansion spaces within said carrier when said bodies are tandemly assembled therein.

9. The perforating apparatus according to claims 1 or 2 wherein the side walls of said selected bodies are cooperatively shaped on either side of said charge-receiving opening for defining detonation-attenuating clearance spaces between said side walls of said selected bodies and the adjacent wall portions of said carrier.

10. Perforating apparatus adapted for operation in a well bore and comprising:

a tubular carrier having an end opening providing access to the internal bore of said carrier; and perforating means including a plurality of shaped explosive charges respectively adapted to be fired in response to a detonation-initiating explosive force acting on a base portion thereof, a plurality of generally-cylindrical modular bodies tandemly assembled within said carrier bore, each of said bodies having an explosive-containing passage entirely contained therein and having a detonating explosive in said passage closed at each end of said passage by closure means thereby creating a stand-alone body for communicating an explosive force from one end of the body to the other end of the body, its ends respectively terminating in a predetermined corresponding location on the opposite ends of each of said bodies so as to respectively position said body passage ends within detonating proximity of one another when said modular bodies are tandemly assembled within said carrier and thereby define an intercommunicating passage through said tandemly-assembled bodies, at least two of said bodies having a laterally-opening charge-receiving cavity arranged thereon and adapted for respectively retaining one of said shaped charges and directinng it in a given direction along a selected perforating axis and positioning its said base portion within detonating proximity of said body passage, wherein the detonation of the explosive in a first modular body is transmitted to all other tandemly assembled bodies via said intercommunicating passage thereby detonating any of said shaped charges retained in any of said bodies.

11. The perforating apparatus of claim 10 wherein each of said generally-cylindrical bodies has a charge-receiving cavity respectively retaining one of said shaped charges.

12. The perforating apparatus of claim 10 wherein only those bodies in a first set of said generally-cylindrical bodies have a charge-retaining cavity and respectively retain one of said shaped charges and those bodies in a second set of said generally-cylindrical bodies are alternately interposed between those bodies in said first set of said generally-cylindrical bodies.

13. The perforating apparatus according to claims 10, 11 or 12 wherein said carrier has longitudinally-spaced wall portions specially adapted to be perforated upon detonation of said shaped charges and further including:

means including body-orienting means cooperatively arranged on each of said generally-cylindrical bodies for orienting each of said bodies within said carrier so as to respectively align the firing axis of each of said shaped charges with said specially-adapted wall portions on said carrier.

14. The perforating apparatus of claim 13 wherein said perforating means further include:

an electrically-responsive detonator cooperatively arranged in said carrier within detonating proximity of said intercommunicating passage.

15. The perforating apparatus of claim 13 wherein said perforating means further include:

a generally-cylindrical member tandemly disposed in said carrier adjacent to one of said generally-cylindrical bodies and having a generally-longitudinal passage arranged therein which terminates in said predetermined corresponding location on one end thereof, an electrically-responsive detonator cooperatively arranged in said generally-longitudinal passage, and a detonating explosive cooperatively arranged in said generally-longitudinal passage for transmitting detonation-initiating forces between said detonator and said detonating-explosive in said intercommunicating passage.

16. The perforating apparatus of claim 13 further including:

means operatively associated with at least some of said generally-cylindrical bodies and adapted for defining a plurality of gas-expansion spaces within said carrier.

17. The perforating apparatus of claim 13 wherein at least some of said generally-cylindrical bodies are formed of a porous material for defining multiple gas-expansion spaces within said carrier.

18. The perforating apparatus of claim 13 wherein at least some of said generally-cylindrical bodies are cooperatively arranged and shaped for defining multiple gas-expansion spaces within said carrier when said bodies are tandemly assembled therein.

19. The perforating apparatus of claim 13 wherein the side walls of said generally-cylindrical bodies are cooperatively shaped on either side of said charge-receiving cavity for defining detonation-attenuating clearance spaces between said side walls of said generally-cylindrical bodies and the adjacent wall portions of said carrier.

20. Perforating apparatus adapted for operation in a well bore and comprising:

a generally-cylindrical body having an outwardly-facing charge-receiving cavity in one side thereof and an elongated passage contained entirely within said generally-cylindrical body extending between the end walls of said generally-cylindrical body with an intermediate portion thereof passing between said cavity and the diametrically-opposite side of said generally-cylindrical body;

a shaped explosive charge cooperatively arranged within said charge-receiving cavity and including a detonation-initiating base portion positioned within detonating proximity of said intermediate passage portion;

a detonating explosive confined within said elongated passage; and means on said body closing the opposite ends of said passage.

21. The perforating apparatus of claim 20 further including: means operatively associated with said generally-cylindrical body and adapted for defining a plurality of gas-expansion spaces within a tubular perforating carrier containing said body.

22. The perforating apparatus of claim 20 wherein said generally-cylindrical body is formed of a porous material selected for defining multiple gas-expansion spaces within a tubular perforating carrier containing said body.

23. The perforating apparatus of claim 20 wherein said generally-cylindrical body is cooperatively arranged and shaped for defining multiple gas-expansion spaces between said body and the interior walls of a tubular perforating carrier containing said body.

24. The perforating apparatus of claim 20 wherein said generally-cylindrical body has one or more recesses shaped for defining multiple gas-expansion spaces between said body and the interior walls of a tubular perforating carrier containing said body.

25. The perforating apparatus of claim 20 wherein said generally-cylindrical body has one or more unblocked passages therein for defining multiple gas-expansion spaces between said body and the interior walls of a tubular perforating carrier containing said body.

26. The perforating apparatus of claim 20 wherein the side walls of said generally-cylindrical body on either side of said charge-receiving cavity are cooperatively recessed for defining detonation-attenuating clearance spaces between said recessed side walls and the adjacent wall portions of a tubular perforating carrier containing said generally-cylindrical body.

27. The perforating apparatus of claim 20 further including body-orienting means cooperatively arranged on said generally-cylindrical body and adapted for cooperation with another substantially-identical, generally-cylindrical body for orienting said generally-cylindrical bodies in a predetermined angular relationship with one another.

* * * * *